US008844730B2

(12) United States Patent
Lins et al.

(10) Patent No.: US 8,844,730 B2
(45) Date of Patent: Sep. 30, 2014

(54) DEVICE AND METHOD FOR MAGNETIC SEPARATION OF A FLUID

(75) Inventors: Günter Lins, Erlangen (DE); Michael Römheld, Uttenreuth (DE)

(73) Assignee: Siemens Aktiengesellschaft, Munich (DE)

( * ) Notice: Subject to any disclaimer, the term of this patent is extended or adjusted under 35 U.S.C. 154(b) by 214 days.

(21) Appl. No.: 13/636,762

(22) PCT Filed: Feb. 24, 2011

(86) PCT No.: PCT/EP2011/052738
§ 371 (c)(1),
(2), (4) Date: Sep. 24, 2012

(87) PCT Pub. No.: WO2011/117039
PCT Pub. Date: Sep. 29, 2011

(65) Prior Publication Data

US 2013/0015106 A1 Jan. 17, 2013

(30) Foreign Application Priority Data

Mar. 23, 2010 (EP) ..... 10157268

(51) Int. Cl.
*B03C 1/00* (2006.01)
*B03C 1/033* (2006.01)
*B03C 1/28* (2006.01)

(52) U.S. Cl.
CPC ..... *B03C 1/288* (2013.01); *B03C 1/0332* (2013.01); *B03C 1/0335* (2013.01); *B03C 2201/22* (2013.01); *B03C 2201/18* (2013.01)
USPC ..... 209/39; 209/223.1; 209/232; 210/222

(58) Field of Classification Search
CPC .. B03C 2201/18; B03C 2201/22; B03B 13/04
USPC ..... 209/214, 223.1, 225–227, 232
See application file for complete search history.

(56) References Cited

U.S. PATENT DOCUMENTS 2,056,426 A * 10/1936 Gibson ..... 209/232
2,678,729 A * 5/1954 Spodig ..... 210/222

(Continued)

FOREIGN PATENT DOCUMENTS

DE 3120718 C1 11/1982 ..... B03C 1/253
DE 3247557 A1 6/1984 ..... B03C 1/034
EP 0718037 A2 6/1996 ..... B03C 1/035

OTHER PUBLICATIONS

Chen, Francis F., "Introduction to Plasma Physics and Controlled Fusion," Second Edition, vol. 1, Plasma Physics, 3 pages, 1984.

(Continued)

*Primary Examiner* — Joseph C Rodriguez
(74) *Attorney, Agent, or Firm* — King & Spalding L.L.P.

(57) ABSTRACT

A device for the magnetic separation of a fluid including first particles to be separated of magnetic or magnetizable material and second particles of non-magnetic or non-magnetizable material may include at least two magnet arrangements for generating a magnetic induction B, which are arranged in line with one another with regard to a center axis M, wherein neighboring magnet arrangements have an opposing pole arrangement and are arranged at a distance d from each other for the generation of a cusp field. The device may also include at least one conveying line for transporting the fluid, the line having a longitudinal axis extending, at least in the region of the magnet arrangements, on a plane aligned perpendicularly in relation to the center axis M between neighboring magnet arrangements. The conveying line(s) may have at least one branch downstream of the center axis M, along the transporting direction of the fluid.

18 Claims, 5 Drawing Sheets

(56) References Cited

U.S. PATENT DOCUMENTS

| | | | | | |
|---|---|---|---|---|---|
| 3,402,820 | A | * | 9/1968 | Lohmann | 210/222 |
| 4,306,970 | A | * | 12/1981 | Tanaka et al. | 210/222 |
| 4,961,841 | A | | 10/1990 | Andres et al. | 209/1 |
| 5,169,006 | A | | 12/1992 | Stelzer | 209/223.1 |
| 5,224,604 | A | * | 7/1993 | Duczmal et al. | 209/12.2 |
| 5,681,478 | A | | 10/1997 | Lea et al. | 210/695 |
| 5,795,470 | A | * | 8/1998 | Wang et al. | 210/222 |
| 6,120,735 | A | | 9/2000 | Zborowski et al. | 422/73 |
| 6,277,275 | B1 | * | 8/2001 | Yoshifusa et al. | 210/222 |
| 2011/0168607 | A1 | * | 7/2011 | Ries | 209/212 |
| 2012/0325728 | A1 | * | 12/2012 | Hartmann et al. | 209/223.1 |

OTHER PUBLICATIONS

Kaneda, M. eta 1., "Convection Induced by a Cusp-Shaped Magnetic Field for Air in a Cube Heated From Above an Cooled From Below," Journal of Heat Transfer, vol. 24, S. 17-25, 9 pages, Feb. 2002.

International Search Report and Written Opinion, Application No. PCT/EP2011/052738, 10 pages, May 23, 2011.

* cited by examiner

DEVICE AND METHOD FOR MAGNETIC SEPARATION OF A FLUID

CROSS-REFERENCE TO RELATED APPLICATIONS

This application is a U.S. National Stage Application of International Application No. PCT/EP2011/052738 filed Feb. 24, 2011, which designates the United States of America, and claims priority to EP Patent Application No. 10157268.3 filed Mar. 23, 2010. The contents of which are hereby incorporated by reference in their entirety.

TECHNICAL FIELD

This disclosure relates to a device and a method for magnetic separation of a fluid which contains first particles of magnetic or magnetizable material to be separated and also second particles of non-magnetic or non-magnetizable material.

BACKGROUND

In the extraction of raw materials in mining it is necessary for example to separate out the desired reusable material particles from the extracted rock. Reusable material in ore extraction are frequently particles of magnetic or magnetizable material which are already contained in the ore and/or particle agglomerates, which arise from non-magnetic valuable minerals and additional magnetic or magnetizable auxiliary particles added to them.

"First particles of magnetic or magnetizable material" are to be understood below not only as particles of the magnetic or magnetizable material already contained in ore but also such magnetically separate particle agglomerates comprising auxiliary particles.

The reusable material particles or agglomerates including the reusable material particles are to be separated from non-valuable particles of non-magnetic or non-magnetizable material.

A mineral or mineral deposit containing metal more or less coalesced with a slag is referred to as an ore. The term "slag" refers to accompanying material which occurs together with the ore minerals, such as quartz, calcite, dolomite etc. Particles of magnetic or magnetizable material already contained in the ore, such as copper, iron etc. are as a rule bound to non-magnetic or non-magnetizable particles of slag and are to be separated from said particles.

The ore is generally crushed and conveyed to a device which promotes the separation of the reusable material particles. To this end the crushed ore is mostly fluidized. The fluid formed involves either a suspension in which the ore particles are dispersed in a fluid or an aerosol in which the ore particles are dispersed in a gas. Suspensions, as are typically created in mining during the extraction of ores for instance, are also referred to as sludges.

In already known methods of magnet separation or magnetic separation use is made of the fact that, in a suitable magnetic field arrangement or magnetic induction arrangement, the magnetic or magnetizable particle experiences a force which moves it or holds it still against other forces acting on it. Such forces are for example gravity or hydrodynamic friction forces in a flowing liquid medium. The magnetic force acting in a magnetic induction B on a magnetic or magnetizable particle is proportional to a product of the magnetic induction B and the component of the gradient of the magnetic induction B in the direction of the magnetic induction B.

To enable a separation of the particles which is as effective as possible to be carried out, fluids in the form of suspensions are chemically pretreated. This is especially to be understood as treating non-magnetic reusable material particles of ore such that they bind themselves to magnetic or non-magnetic auxiliary particles added thereto, such as magnetite for example, and can be magnetically separated together with these. For this purpose the surface of the non-magnetic reusable material particle is selectively functionalized, with sulfidic ores for instance with the aid of suitable xanthates. If the added magnetic or magnetizable auxiliary particles are also functionalized in a similar manner, these functional layers can enter into stable compounds with one another and thus lead to the formation of stable particle agglomerates of magnetic or magnetizable auxiliary particles and non-magnetizable reusable material particles. These agglomerates can then be separated from the suspension as magnetizable individual particles.

At present both permanent magnets and also electric magnets are used in magnetic separators.

Permanent magnets are to be found for example in the widely-used drum separators where, circulating in the drum, they act on magnetic or magnetizable particles.

DE 31 20 718 C1 discloses a further drum magnet separator for separating and sorting magnetizable substances from a mixture containing magnetizable and non-magnetizable substances, wherein the magnet system of the magnet separator generates a traveling field.

A use of electromagnets is especially known from what is referred to as high-gradient magnetic separation, in which magnetizable structures, such as needles or cutting edges, form a grid in an electrically-generated often initially homogeneous magnetic induction B. The grid structure generates a locally strongly inhomogeneous magnetic induction B with marked gradients.

DE 32 47 557 A1 describes a device for high-gradient magnetic separation of the finest magnetizable particles from a flowing medium.

A disadvantage of such high-gradient magnetic separators is that, often to remove the separated magnetic or magnetizable particles, the magnetic induction B is switched off and a back flushing process has to be carried out. This means that continuous operation is not possible.

In the interim it has also proved disadvantageous for the operation of devices for magnetic separation if the permanent magnets or electromagnets generating the magnetic induction B during the separation process have to be mechanically moved, since these types of devices are susceptible to faults.

U.S. Pat. No. 6,120,735 describes a method and device for fraction sorting of cells comprising a two or four-pole magnet arrangement.

U.S. Pat. No. 4,961,841 describes a device and a method for separating particles in a gravitation field based on separation into their magnetic properties and their density.

U.S. Pat. No. 5,169,006 describes a continuous magnetic separator comprising rods with alternating areas of non-magnetic and ferromagnetic material.

SUMMARY

In one embodiment, a device for magnetic separation of a fluid, containing first particles of magnetic or magnetizable material and also second particles of non-magnetic or non-magnetizable material to be separated, may comprise: at least two magnet arrangements for generating a magnetic induction in each case, which are arranged flush with one another in respect of a center axis, wherein neighboring magnet arrangements have an opposing pole arrangement and are disposed spaced at a distance d from one another for generating a cusp field, and at least one conveying line for transport of the fluid, of which the longitudinal axis at least in the area of the magnet arrangements is routed through on a plane aligned perpendicular to the center axis between neighboring magnet arrangements, wherein the at least one conveying line, seen in the direction of transport of the fluid has at least one branch downstream of the center axis, and wherein a cross section of the least one conveying line is disposed entirely in one area in which a product of the magnetic induction of the respective magnet arrangement and a gradient of the respective magnetic induction is positive, and wherein an area of a wall of the conveyor line, which is located at a maximum or minimum perpendicular distance from the center axis, runs along a line at which the gradient of the respective magnetic induction is equal to zero.

In a further embodiment, the at least one conveying line is routed through at a distance d/2 between neighboring magnet arrangements. In a further embodiment, at least one molded body made of a paramagnetic or ferromagnetic material with a permeability number $\mu>1$ is disposed in the area of the wall of the conveying line. In a further embodiment, the molded body is embodied in the form of a rod and is disposed with its longitudinal axis in parallel to the longitudinal axis of the at least one conveying line and in the plane aligned perpendicular to the center axis between neighboring magnet arrangements. In a further embodiment, at least three magnet arrangements are present. In a further embodiment, the magnet arrangements are formed by electromagnets. In a further embodiment, the magnet arrangements are formed by electromagnets in the form of magnet ring coils. In a further embodiment, the magnet ring coils are embodied with elongated, oval coil windings and the longitudinal axis of the at least one conveying line is aligned in parallel to a long side of the oval. In a further embodiment, the magnet arrangements are formed by permanent magnets. In a further embodiment, at least two conveying lines are present, the longitudinal axes of which, in the area of the magnet arrangements, are routed through on the plane aligned perpendicularly to the center axis between the neighboring magnet arrangements. In a further embodiment, the at least one branch of the at least one conveying line is configured to separate a first phase of the fluid containing predominantly first particles from a second phase containing predominantly second particles. In a further embodiment, the at least one conveying line is divided by the at least one branch into a first pipe for accepting the first phase and a second pipe for accepting the second phase, especially wherein a cross section of the first pipe is proportional to the amount of first phase formed. In a further embodiment, a cross-sectional circumference of the at least one conveying line is embodied in the form a rectangle, wherein a long side of the rectangle is aligned in parallel to the plane aligned perpendicular to the center axis between neighboring magnet arrangements.

In another embodiment, a method for magnetic separation of a fluid, which contains first particles of magnetic or magnetizable material and also second particles of non-magnetic or non-magnetizable material to be separated, using a device having any of the features disclosed above, including the following steps: generation of a respective magnetic induction by means of the at least two magnet arrangements; conveying the fluid through the at least one conveying line between the at least two magnet arrangements, wherein the fluid is divided into at least one first phase containing predominantly first particles and at least one second phase containing predominantly second particles, and separation of the at least one first phase from the at least one second phase in the area of the at least one branch.

In a further embodiment, magnet arrangements in the form of magnet ring coils are used and wherein neighboring magnet ring coils have direct current flowing through them in opposing directions.

In another embodiment, a use of a device having any of the features disclosed above is provided for magnetic separation of magnetic or magnetizable first particles comprising ore from non-magnetic or non-magnetizable second particles comprising slag.

BRIEF DESCRIPTION OF THE DRAWINGS

Example embodiments will be explained in more detail below with reference to figures, in which.

DETAILED DESCRIPTION

Figure 1:
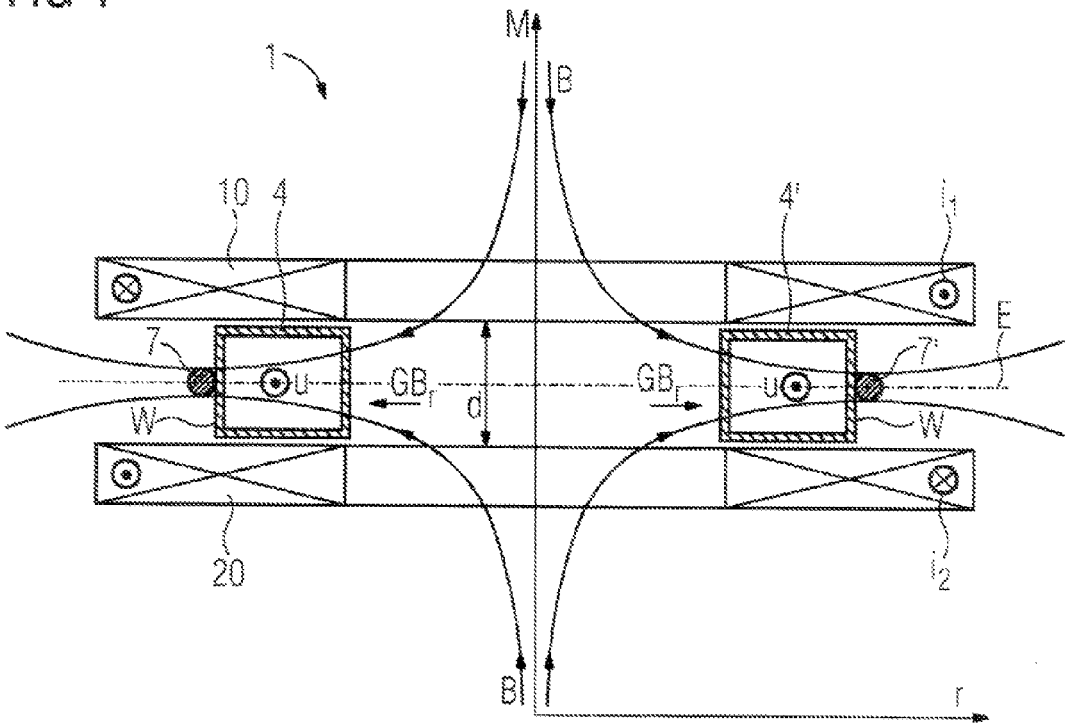
FIG. 1 shows a first device with two magnet arrangements, in the form of magnet ring coils, in cross section.

Some embodiments disclosed herein provide an improved device and an improved method for magnetic separation of a fluid.

For example, some embodiments provide a device for magnetic separation of a fluid which contains first particles of magnetic or magnetizable material and also second particles of non-magnetic or non-magnetizable material to be separated, in that the device comprises the following:

at least two magnet arrangements for respectively generating a magnetic induction B, which are disposed flush with one another in respect of a center axis M, with adjacent magnet arrangements having an opposing pole arrangement and being spaced at a distance d from one another to generate a cusp field, and at least one conveying line to transport the fluid, the longitudinal axis of which, at least in the area of the magnet arrangements, is routed through on a plane E aligned perpendicularly to the center axis M between neighboring magnet arrangements, wherein the at least one conveying line, seen in the direction of transport of the fluid downstream of the center axis M, has at least one branch, and wherein a cross section of the at least one conveying line is disposed completely in an area in which a product of the magnetic induction B of the respective magnet arrangement and a gradient GBr of the respective magnetic induction B is positive, and wherein an area W of a wall of the conveying line which is located at a maximum or minimum perpendicular distance r from the center axis M, runs along a line P on which the gradient GBr of the respective magnetic induction B is equal to zero.

A "first particle of magnetic or magnetizable material" is to be understood here and subsequently not only as a particle of magnetic or magnetizable material already contained in the ore but also a particle agglomerate which comprises at least one non-magnetic reusable material particle and at least one magnetic or magnetizable auxiliary particle bound thereto via functional layers.

Because of the opposing pole arrangement of the magnet arrangements, a radial magnetic induction B with a gradient GBr aligned in parallel to the direction of the magnetic induction B is generated over an extended spatial area. What is known as a cusp field, known from plasma physics, is generated. Cf. here for example F. F. Chen, "Introduction to Plasma Physics and Controlled Fusion", Second Edition, Volume 1: Plasma Physics, Plenum Press, New York, 1984, P. 45 or M. Kaneda, T. Tagawa, H. Ozoe, "Convection Induced by a Cusp-Shaped Magnetic Field for Air in a Cube Heated From Above and Cooled From Below", Journal of Heat Transfer, Vol. 124, February. 2002, P. 17-25.

Other embodiments provide a method for magnetic separation of a fluid which contains first particles of magnetic or magnetizable material and also second particles of non-magnetic or non-magnetizable material to be separated, using the device disclosed herein, by the following steps being performed:

- Generation of a respective magnetic induction B by means of the at least two magnet arrangements;
- Conveying the fluid through the at least one conveying line between the at least two magnet arrangements, wherein the fluid is divided into at least one first phase containing predominantly first particles and at least one second phase containing predominantly second particles, and
- Separation of the at least one first phase from the at least one second phase in the area of the at least one branch.

In some embodiments, the disclosed device or method make ongoing, fault-free continuous operation possible with a permanently high separation power. Since the device has a particularly simple structure and does not have any moving parts, no maintenance effort or only a low maintenance effort is involved. The personnel requirement for operating a device as disclosed herein is thus minimal and the operating costs are small. The throughput of fluid to be separated is high overall so that, per unit of time, a higher yield can be achieved than with the conventional magnetic separation methods.

In some embodiments, a cross section of the at least one conveying line is completely arranged in an area in which a product of the magnetic induction B of the respective magnet arrangement and a gradient GBr of the respective magnetic induction B is positive, wherein an area W of a wall of the conveying line which is located at a maximum or minimum perpendicular distance r from the center axis M runs along a line P at which the gradient GBr of the respective magnetic induction B is equal to zero. This causes the first particles to collect in the area W of the wall of the tubular line without wanting to adhere there. The first particles can thus be transported away even at very low flow speeds of the fluid with the at least one first phase. Regular checking of the at least one conveying line in respect of whether its line cross-section has reduced because of adhering first particles, for example by means of a pressure measurement or visual check, can be dispensed with entirely. The effectiveness and performance of the method and the device is enormously increased by this.

A proven approach is for the magnet arrangements to be embodied so that they can generate magnetic inductions B of equal size in terms of their amount. In this case the longitudinal axis of the at least one conveying line may be routed through at a distance d/2 between neighboring magnet arrangements.

Disposed in the area W of the wall of the conveying line may be at least one molded body made of a paramagnetic or ferromagnetic material with a permeability number $\mu>1$. This serves to increase the magnetic field gradients in the area W of the wall of the conveying line and to improve the separation of the first phase from the second phase. The molded body may be embodied in the shape of a rod and is disposed with its longitudinal axis in parallel to the longitudinal axis of the at least one conveying line and in the plane E.

The device may include at least three magnet arrangements. Such a connection of magnet arrangements one behind the other makes it possible to use a magnet arrangement disposed between two magnet arrangements in two ways, in that at least one conveying line can be disposed between this magnet arrangement and the two neighboring magnet arrangements to this. This reduces the costs for the device and increases the effectiveness of the method.

The magnet arrangements may be formed by electromagnets, especially in the form of magnet ring coils. In order to achieve the required opposing pole arrangement adjacent magnet ring coils have direct current flowing through them in opposite directions. In such cases it may be advantageous if, for the direct currents $i_1$, $i_2$ in two adjacently disposed magnet ring coils, the following equation applies: $i_1=-i_2$.

The magnet ring coils may be embodied with elongated oval coil windings. The longitudinal axis of the at least one conveying line may be aligned in parallel to a long side of the oval of the coil windings, so that an influence of the magnetic induction B on the fluid is achieved over the longest possible distance and the separation power is improved.

As an alternative however the magnet arrangements can also be formed by permanent magnets. As a rule this involves cuboid block magnets with a height h, a width b and a length l which are magnetized in the direction of their height h. Neighboring permanent magnets are disposed so that their North poles or South poles point towards each other. Since permanent magnets can not be manufactured with random dimensions, a number n of magnets of length l are arranged one after the other in order along a conveying line to achieve an effect of the magnetic induction B on the fluid over a greatest possible distance.

The device may include at least two conveying lines of which the longitudinal axes are routed through in the area of the magnet arrangements on the plane E disposed perpendicular to the center axis M, especially at a distance of d/2, between the neighboring magnet arrangements. This enables the amount of fluid which can be treated by the device to be doubled.

The at least one branch of the at least one conveying line is configured to separate off at least one first phase of the fluid containing predominantly first particles from the at least one second phase of the fluid containing predominantly second particles. The at least one conveying line may be divided by means of a branch into at least one first pipe for accepting the at least one first phase and a second pipe for accepting the at least one second phase. A cross section of the first pipe in this case is especially proportional to the formed amount of first phase. To obtain a finer division of the separated fluid, the branching of the conveying line can of course also be split into more than two pipes.

In particular a cross-sectional extent of the at least one conveying line is embodied in the form of a rectangle, with a longitudinal side of the rectangle being parallel to plane E. This supports an explicit separation of the fluid into the first and second phases, especially with a first phase collecting to allow good separation in the area W of the wall of the conveying line.

In some embodiments, the device may be used to magnetically separate magnetic or magnetizable first particles comprising ore from non-magnetic or non-magnetizable second particles from slag.

Figure 2:
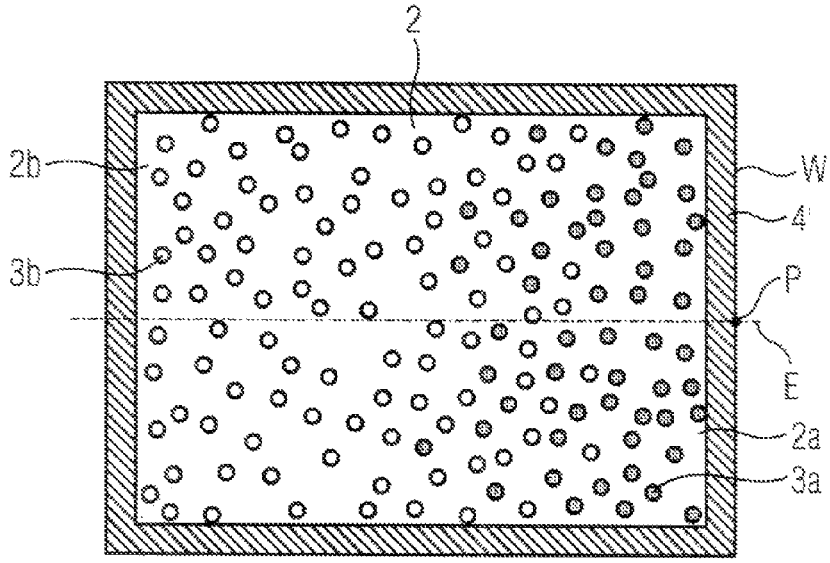
FIG. 2 shows an enlarged section from the first device in the area of one of the two conveying lines during the magnetic separation.

FIG. 1 shows a cross section of a first device 1 for magnetic separation of a fluid 2 containing first particles 3*a* of magnetic or magnetizable material and also second particles 3*b* of non-magnetic or non-magnetizable material to be separated from one another (see also FIG. 2). The first device 1 comprises two magnet arrangements 10, 20 of a similar type in the form of electromagnets, here in the form of magnet ring coils, for creation of a magnetic induction B in each case. The two magnet arrangements 10, 20 are spaced at a distance d from one another and are disposed flush with one another in respect of a center axis M, with the arrangements having an opposing pole arrangement. This is created by the magnet ring coils having the currents $i_1$, $i_2$ flowing through them in opposite directions. The necessary power connections for the magnet ring coils have been omitted here and in subsequent figures for reasons of clarity.

The equation $i_1=-i_2$ may apply here. In this case the magnetic inductions B generated by the magnet ring coils are equal in terms of their amount and directed against each other in the area of the center axis M. The North poles of the magnet arrangements 10, 20 each point towards the conveying lines 4, 4', which are disposed between the two magnet arrangements 10, 20. A cusp field is formed. As the distance r from the center axis M increases, the magnetic inductions B, particularly in the area between the magnet ring coils, possess predominantly radial components, wherein the magnetic induction B initially exhibits a gradient GBr positive in the radial direction. As the distance r from the center axis M increases, a line P is reached, at which the gradient is GBr=0. The gradient GBr then changes its leading sign and becomes negative.

The two conveying lines 4, 4' serve to transport a fluid 2, in this case for example a suspension based on water containing the first and the second particles 3*a*, 3*b*, starting from the flat plane in the direction of the observer, at a speed u. The longitudinal axes $L_{FL}$, $L_{FL}'$ of the conveying lines 4, 4' (cf. FIG. 3) are routed through in the area of the magnet arrangements 10, 20, on a plane E arranged perpendicular to the center axis M at a distance d/2 between the neighboring magnet arrangements 10, 20. The cross section of the respective conveying line 4, 4' is disposed completely in an area in which a product of the magnetic induction B of the respective magnet arrangement 10, 20 and a gradient GBr of the respective magnetic induction B is positive.

An area W of the wall of the conveying line 4, 4', which is located at a maximum perpendicular distance from the center axis M, runs along a line P at which the gradient GBr of the respective magnetic induction B is equal to zero.

Disposed in the area W of the wall of the conveying lines 4, 4', for increasing the magnetic field gradients is a molded body 7, 7' made from a paramagnetic or ferromagnetic material with a permeability number $\mu>1$. The molded body 7, 7' is embodied in the shape of a rod and is disposed with its longitudinal axis in parallel to the longitudinal axis $L_{FL}$, $L_{FL}$ of the conveying lines 4, 4' and in the plane E.

FIG. 2 shows an enlarged section from the first device 1 in the area of the conveying line 4' to the right in the diagram during operation of the first device 1. During the magnetic separation by means of the first device 1 the magnet arrangements 10, 20 have current $i_1=-i_2$ flowing through them in opposite directions and the magnetic inductions B form the cusp field. The fluid 2 is conveyed through the conveying lines 4, 4', wherein it is moved at a speed u between the two magnet arrangements 10, 20. The fluid 2 flows in this case in the conveying lines 4, 4' in the same direction. In this case the fluid 2 is separated into a first phase 2*a* containing predominantly first particles 3*a* and a second phase 2*b* containing predominantly second particles 3*b*. The magnetic force directed radially outwards has the effect of making the first particles 3*a* collect in the area W of the wall of the respective conveying line 4, 4' which is located at a maximum perpendicular distance r from the center axis M. Since the magnetic force is approximately equal to zero here or GBr=0 respectively, there is no adhesion of the first particles to the wall of the conveying lines 4, 4' in area W. Instead the first phase 2*a* with the first particles 3*a* will be transported on with the flow. In such cases the flow in the conveying lines 4, 4' is especially laminar, to prevent the already separated first and second phases 2*a*, 2*b* from mixing with each other again. The first phase 2*a* can now be separated mechanically from the second phase 2*b*.

Figure 3:
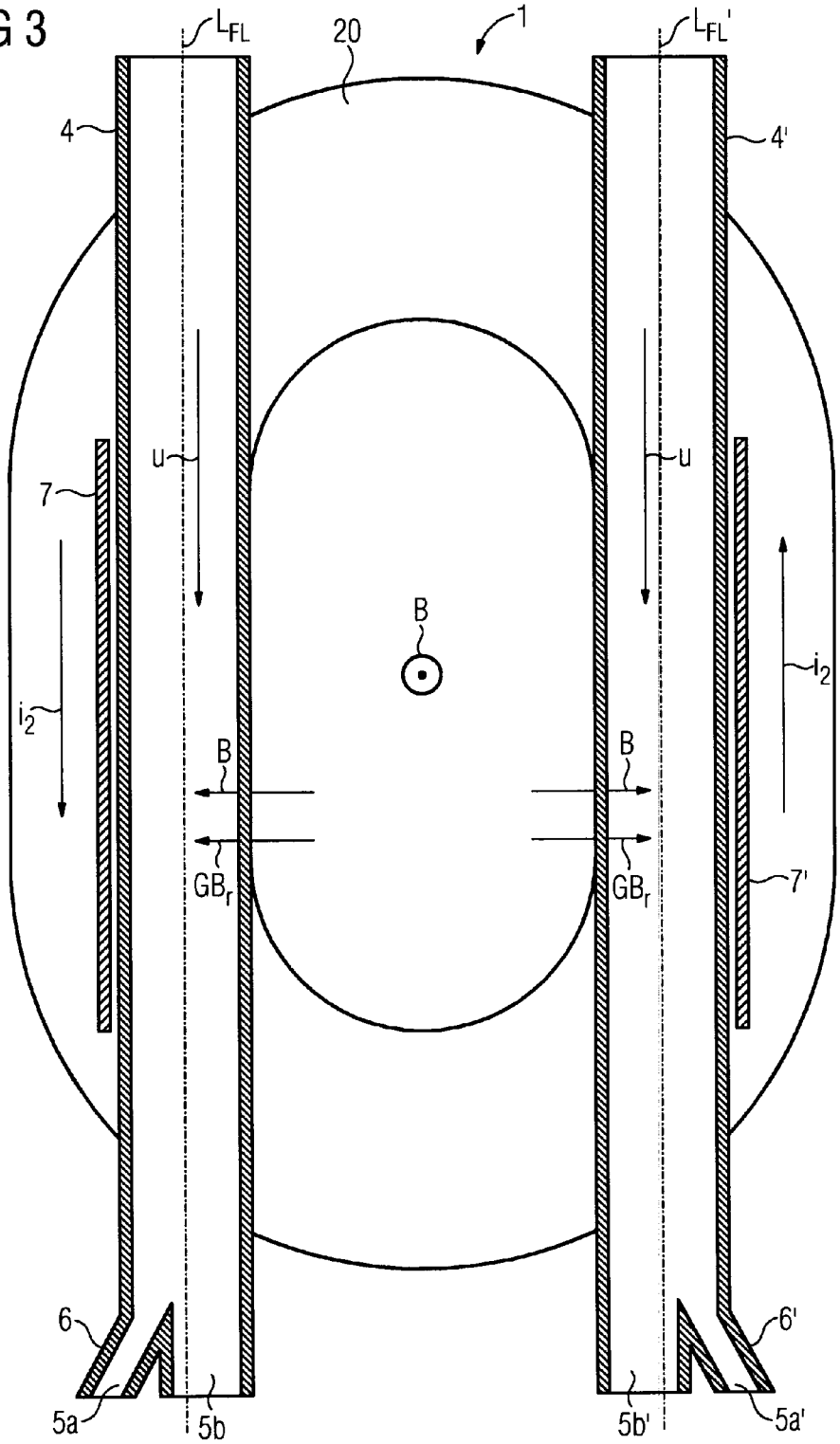
FIG. 3 shows the first device viewed from above at a cross section in the area of the plane E.

FIG. 3 shows the first device 1 viewed from above onto the conveying lines 4, 4' and one of the magnet arrangements 20, cut in the plane E. It can be seen that the magnet ring coils are embodied with elongated oval coil windings and the longitudinal axes $L_{FL}$, $L_{FL}'$ of the two conveying lines 4, 4' are aligned in parallel to a long side of the oval of the coil windings. This guarantees that the magnetic inductions B act over a largest possible distance in the conveying lines 4, 4' on the fluid 2 flowing through the lines in each case.

The conveying lines 4, 4', seen in the transport direction of the fluid 2 downstream of the center axis M, also after leaving the space between the magnet arrangements 10, 20, each have a branch 6, 6'. There the conveying lines 4, 4' are each divided into a first pipe 5*a*, 5*a'* for accepting a first phase 2*a* and a second pipe 5*b*, 5*b'* for accepting a second phase 2*b*. A cross section of the first pipe 5*a*, 5*a'* in this case may be proportional to the amount of first phase 2*a* formed, in order to guarantee the most precise separation possible of the first phase 2*a* (see FIG. 2).

Figure 4:
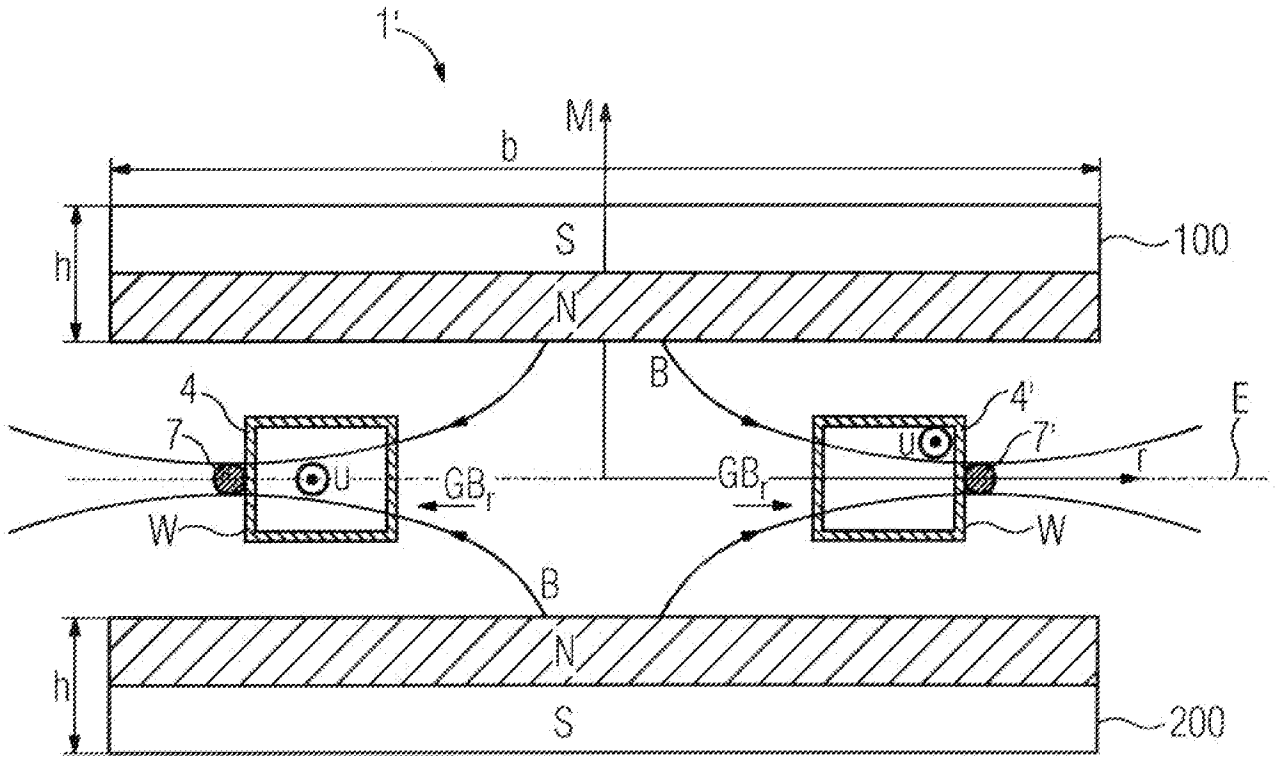
FIG. 4 shows the second device with magnet arrangements in the form of permanent magnets in cross section.

FIG. 4 shows a cross section of second device 1' with magnet arrangements 100, 200 in the form of identically-constructed permanent magnets. The cuboid, so-called block magnets with a height h, a width b and a length l are magnetized in the direction of the height h and are disposed so that their magnetic North poles N lie opposite one another and the magnetic South poles S are facing away from one another. The configuration of the magnetic inductions B corresponds to that of the first device 1 in accordance with FIG. 1. The second device 1' also functions in a similar way to the first device 1.

Figure 5:
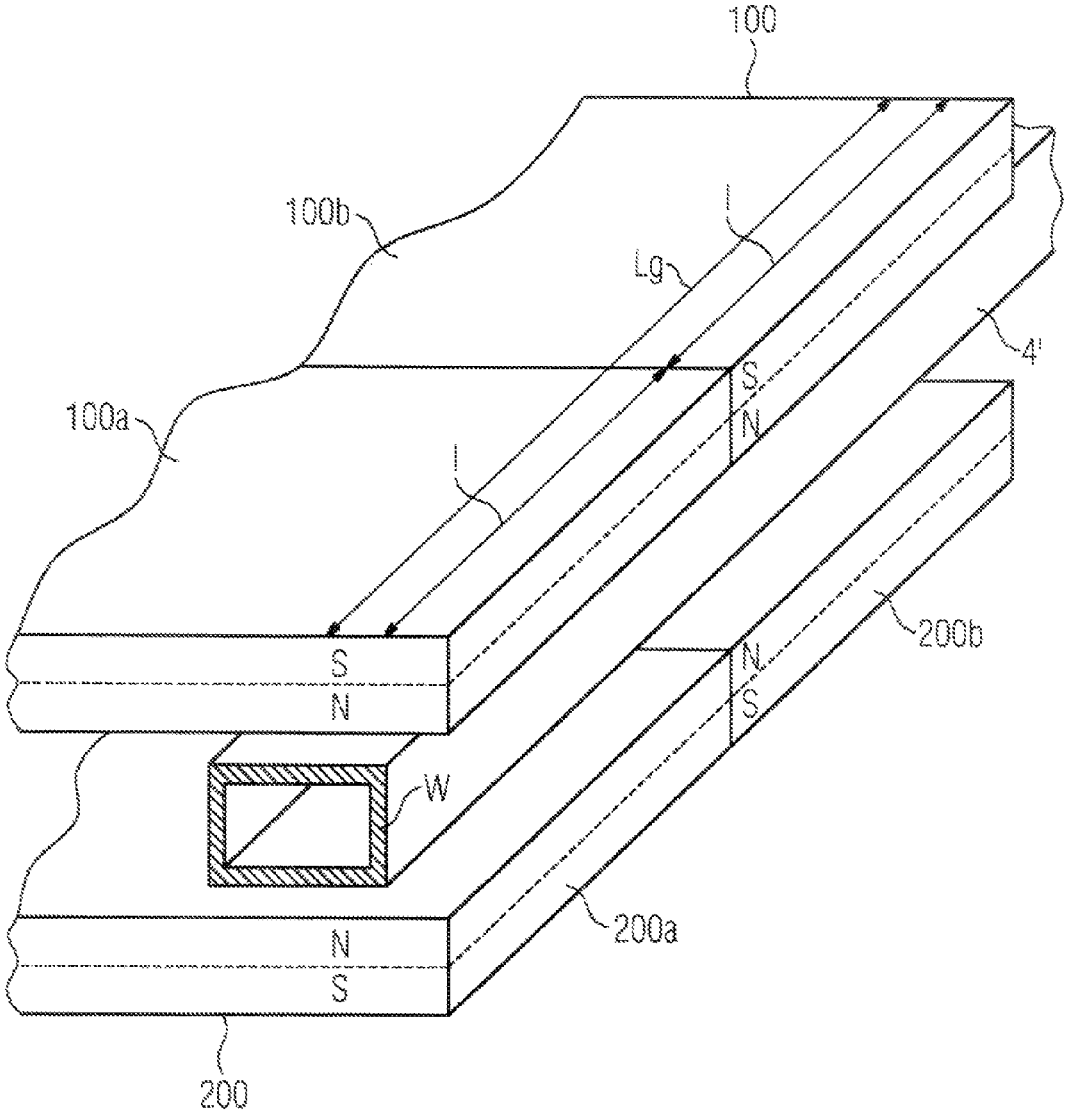
FIG. 5 shows a section from the second device in accordance with FIG. 4 in a three-dimensional view.

Since block magnets are not able to be manufactured with random dimensions, a number n of the magnets of length l are disposed next to one another in the longitudinal direction 1, i.e. in parallel to plane E, so that magnet arrangements 100, 200 of the overall length Lg=n*l are produced. Cf. FIG. 5, which shows such an arrangement or a section of the second device in accordance with FIG. 4 in a three-dimensional view by way of illustration. In this case, for improved clarity the molded body 7' made of paramagnetic or ferromagnetic material has been omitted. The magnet arrangement 100 comprises according to FIG. 5 n=2 permanent magnets 100*a*, 100*b* each with the length l. The magnet arrangement 200 is composed according to FIG. 5 of n=2 permanent magnets 200*a*, 200*b*, each with the length l.

Figure 6:
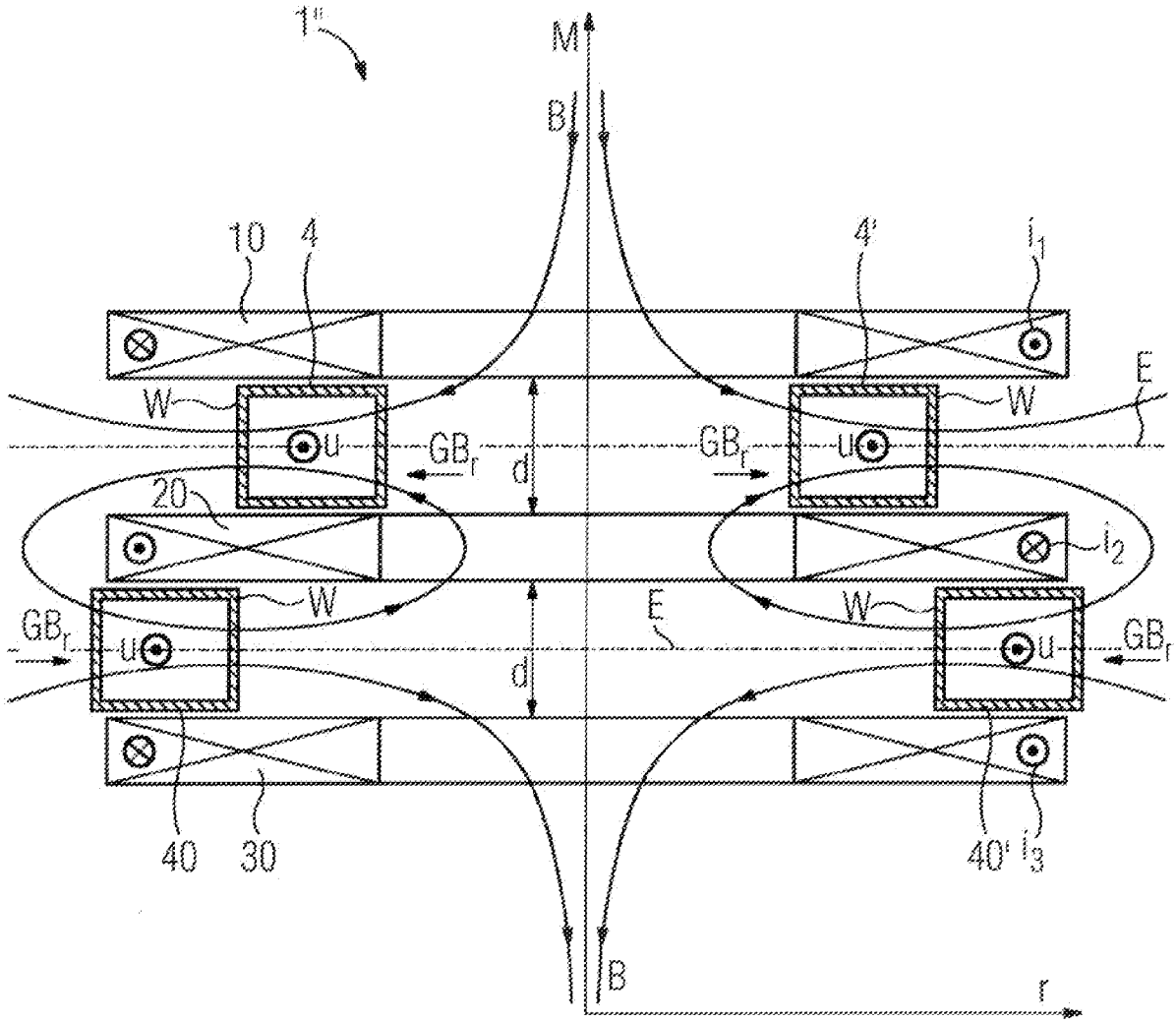
FIG. 6 shows a third device with three magnet arrangements in the form of magnet ring coils in cross section.

FIG. 6 shows a cross-section of a third device 1" for magnetic separation of a fluid 2, which contains first particles 3*a* of magnetic or magnetizable material and also second particles 3*b* of non-magnetic or non-magnetizable material to be separated (see also FIG. 2). The third device 1" comprises three magnet arrangements 10, 20, 30 in the form of electromagnets, here in the form of magnet ring coils, for generating a magnetic induction B in each case. The magnet arrangements 10, 20, 30 are each spaced at a distance d from one another and are arranged flush with one another in respect of a center axis M, with an opposing pole arrangement being present for generation of cusp fields. This is achieved by the magnet ring coils having the currents $i_1$, $i_2$, $i_3$ flowing through them in opposite directions. The following equation may apply here: $i_1=-i_2=i_3$. In this case the magnetic inductions B generated by the magnet ring coils are equal in terms of their amount and are aligned in opposition to one another in the area of their center axis M. Thus the North poles of the magnet arrangements 10, 20 each point to the conveying lines 4, 4', which are disposed between the two magnet arrangements 10, 20. The upper half of the third device 1" comprising the magnet arrangements 10, 20 thus corresponds to the layout in accordance with FIGS. 1 to 3. As the distance r from the center axis M increases, the magnetic inductions B of the magnet arrangements 10, 20, especially in the area between the magnet ring coils, possess predominantly radial components, wherein the magnetic induction B initially has a positive gradient GBr in a radial direction. As the distance r from the center axis M increases, a line P is reached at which the gradient is GBr=0. The gradient GBr then changes its leading sign and becomes negative.

By contrast the South poles of the magnet arrangements 20, 30 point towards the conveying lines 40, 40', which are disposed between the two magnet arrangements 20, 30. As the distance r from the center axis M increases, the magnetic inductions B of the magnet arrangements 20, 30, especially in the area between the magnet coils, predominantly possess components pointing in the direction of the center axis M, with the magnetic induction B initially exhibiting a positive gradient GBr. As the distance r from the center axis M increases, a line P is reached, at which the gradient is GBr=0. Then the gradient GBr changes its leading sign and becomes negative.

The four conveying lines 4, 4'; 40, 40' are used to transport a fluid 2, here for example a suspension based on water, starting from the flat plane in the direction of the observer, at a speed u. The longitudinal axes $L_{FL}$, $L_{FL}'$ of the conveying lines 4, 4' (cf. FIG. 3) are routed through in the area of the magnet arrangements 10, 20 on a plane E perpendicular to the center axis M at a distance d/2 between neighboring magnet arrangements 10, 20. The longitudinal axes of the conveying lines 40, 40' not shown are routed through in the area of the magnet arrangements 20, 30 on a further plane E aligned perpendicular to the center axis M at a distance d/2 between the neighboring magnet arrangements 20, 30.

The cross section of the respective conveying line 4, 4'; 40, 40' is disposed entirely in an area in which a product of the magnetic induction B of the respective magnet arrangement 10, 20; 20, 30 and a gradient GBr of the respective magnetic induction B is positive. The areas W of the walls of the conveying lines 4, 4', which are located at a maximum perpendicular distance r from the center axis M, run along the line P, on which the gradient GBr of the respective magnetic induction B is equal to zero. The areas W of the walls of the conveying lines 40, 40', which run at a minimum perpendicular distance r from the center axis M, run along the line P, at which the gradient GBr of the respective magnetic induction B is equal to zero.

Thus if the North poles of two neighboring magnet arrangements point towards one another, the area W of the wall of the conveying line(s) which runs along the line P then points away from the center axis M and is located at a maximum distance r from said axis. If on the other hand the South poles of two neighboring magnet arrangements point towards each other, the area W of the walls of the conveying line which runs along the line P points towards the center axis M and is located at a minimum distance r from said axis. For a number of magnet arrangements connected behind one another with an opposing pole arrangement the line cross sections of the conveying line, seen in cross-section lie once inside the line P and once outside the line P seen from the center axis M the.

FIGS. 1 to 6 show examples for devices and methods according to example embodiments. A device can thus feature any given number of magnet arrangements in the form of electromagnets or alternatively permanent magnets. A combination of magnet arrangements in the form of electromagnets and permanent magnets can also be used if these magnets are operated with an opposing pole arrangement and may deliver approximately the same magnetic induction B in terms of amount. Molded bodies made from a paramagnetic or ferromagnetic material with a permeability number $\mu>1$ can be used both with arrangements having magnet arrangements in the form of electromagnets, as shown in FIGS. 1, 3 and 6, and also with devices having magnet arrangements in the form of permanent magnets, as shown in FIGS. 4 and 5. Furthermore the shape of the electromagnets or permanent magnets is largely freely selectable, wherein however to improve the separation power of the device and of the method, the area W of the walls of the at least one conveying line may be routed over the longest possible distance along the line P.

What is claimed is:

1. A device for magnetic separation of a fluid containing first particles of magnetic or magnetizable material and second particles of non-magnetic or non-magnetizable material to be separated, the device comprising:

at least two magnet arrangements, each configured to generate a magnetic induction, the at least two magnet arrangements arranged flush with one another with respect to a center axis, wherein neighboring magnet arrangements have an opposing pole arrangement and are disposed spaced at a distance d from one another for generating a cusp field, and at least one conveying line configured to transport the fluid, wherein longitudinal axis of the at least on conveying line, at least in the area of the magnet arrangements, is routed through a plane aligned perpendicular to the center axis between neighboring magnet arrangements, wherein the at least one conveying line has at least one branch downstream of the center axis in the direction of transport of the fluid, and wherein a cross section of the least one conveying line is disposed entirely in one area in which a product of the magnetic induction of the respective magnet arrangement and a gradient of the respective magnetic induction is positive, and wherein an area of a wall of the conveyor line, which is located at a maximum or minimum perpendicular distance from the center axis, runs along a line at which the gradient of the respective magnetic induction is equal to zero.

2. The device of claim 1, wherein the at least one conveying line is routed through at a distance d/2 between neighboring magnet arrangements.

3. The device of claim 1, wherein at least one molded body made of a paramagnetic or ferromagnetic material with a permeability number $\mu > 1$ is disposed in the area of the wall of the conveying line.

4. The device of claim 3, wherein the molded body is embodied in the form of a rod and is disposed with its longitudinal axis in parallel to the longitudinal axis of the at least one conveying line and in the plane aligned perpendicular to the center axis between neighboring magnet arrangements.

5. The device of claim 1, comprising at least three magnet arrangements.

6. The device of claim 1, wherein the magnet arrangements are formed by electromagnets.

7. The device of claim 6, wherein the magnet arrangements are formed by electromagnets in the form of magnet ring coils.

8. The device of claim 7, wherein the magnet ring coils are embodied with elongated, oval coil windings and the longitudinal axis of the at least one conveying line is aligned in parallel to a long side of the oval.

9. The device of claim 1, wherein the magnet arrangements are formed by permanent magnets.

10. The device of claim 1, comprising at least two conveying lines, wherein the longitudinal axes of the at least, two conveying lines, in the area of the magnet arrangements, are routed through the plane aligned perpendicularly to the center axis between the neighboring magnet arrangements.

11. The device of claim 1, wherein the at least one branch of the at least one conveying line is configured to separate a first phase of the fluid containing predominantly first particles from a second phase containing predominantly second particles.

12. The device of claim 11, wherein the at least one conveying line is divided by the at least one branch into a first pipe for accepting the first phase and a second pipe for accepting the second phase.

13. The device of claim 12, wherein a cross-sectional circumference of the at least one conveying line is embodied in the form a rectangle, wherein a long side of the rectangle is aligned in parallel to the plane aligned perpendicular to the center axis between neighboring magnet arrangements.

14. A method for magnetic separation of a fluid, which contains first particles of magnetic or magnetizable material and also second particles of non-magnetic or non-magnetizable material to be separated, using a device comprising at least two magnetic-induction-generating magnet arrangements arranged flush with one another with respect to a center axis, wherein neighboring magnet arrangements have an opposing pole arrangement and spaced apart from each other by a distance d for generating a cusp field, and at least one conveying line having at least one branch downstream of the center axis, along a fluid transport direction, wherein the method comprises:

generating a respective magnetic induction by means of the at least two magnet arrangements;

conveying the fluid through the at least one conveying line between the at least two magnet arrangements, wherein the fluid is divided into at least one first phase containing predominantly first particles and at least one second phase containing predominantly second particles, and separating the at least one first phase from the at least one second phase in the area of the at least one branch.

15. The method of claim 14, wherein magnet arrangements in the form of magnet ring coils are used and wherein neighboring magnet ring coils have direct current flowing through them in opposing directions.

16. The method of claim 14, comprising at least three magnet arrangements.

17. The method of claim 14, comprising at least two conveying lines.

18. The method of claim 14, wherein the at least one branch of the at least one conveying line is configured to separate a first phase of the fluid containing predominantly first particles from a second phase containing predominantly second particles.

* * * * *